US005895160A

United States Patent [19]

Ginelli

[11] Patent Number: 5,895,160

[45] Date of Patent: Apr. 20, 1999

[54] UNIVERSAL MARKING INSTRUMENT APPARATUS

[75] Inventor: Richard Ginelli, Oakland, N.J.

[73] Assignee: Pentech International Inc., Edison, N.J.

[21] Appl. No.: 09/139,620

[22] Filed: Aug. 25, 1998

Related U.S. Application Data

[62] Division of application No. 08/923,305, Sep. 4, 1997.

[51] Int. Cl.[6] ..... B05C 1/00; B43K 5/00

[52] U.S. Cl. ..... 401/17; 401/133; 401/198; 401/199; 401/207; 401/34

[58] Field of Search ..... 401/17, 133, 198, 401/199, 207, 34; 285/322, 323; 403/329, 378

[56] References Cited

U.S. PATENT DOCUMENTS

| | | |
|---|---|---|
| D. 279,992 | 8/1985 | Gribb . |
| D. 295,878 | 5/1988 | Lovell . |
| D. 321,717 | 11/1991 | Hager . |
| D. 328,917 | 8/1992 | Shike et al. . |
| D. 329,873 | 9/1992 | Tu . |
| D. 336,425 | 6/1993 | Napora, Jr. . |
| D. 336,922 | 6/1993 | Lin . |
| D. 355,933 | 2/1995 | Collins . |
| D. 362,649 | 9/1995 | Rak et al. . |
| D. 366,279 | 1/1996 | Voorhees . |
| 1,108,314 | 8/1914 | Anderson . |
| 2,456,904 | 12/1948 | Wahlstrom . |
| 2,783,711 | 3/1957 | Vance . |
| 3,043,316 | 7/1962 | Bolser . |
| 3,251,344 | 5/1966 | Dorna et al. . |
| 3,464,352 | 9/1969 | Schilling . |
| 3,684,389 | 8/1972 | Eron et al. . |
| 3,690,777 | 9/1972 | Costa . |
| 3,733,139 | 5/1973 | Neidhardt et al. . |
| 3,765,780 | 10/1973 | Guu et al. . |

(List continued on next page.)

*Primary Examiner*—Robert M. Fetsuga
*Assistant Examiner*—Tuan N. Nguyen
*Attorney, Agent, or Firm*—Sperry, Zoda & Kane

[57] ABSTRACT

An apparatus for facilitating the manufacture of various different configurations of marking instruments which utilizes a uniquely configured nib holder which includes a media transfer channel therethrough along with a nib mounting ring and securement prong or finger apparatus for facilitating the mounting and retaining of a marking nib therewithin. A conventional marker barrel being generally tubular with end openings is included which can be used for forming either single or double ended marking pens which share a common marking media reservoir or have different media used therewith. The nib mounting ring of the nib holder is designed to orient the nib centrally within the media transfer channel at the nib holder and the securement prongs are adapted to abut and grip the nib holder for retaining in position therethrough and preferably in abutment with respect to a conventional generally fibrous marking media reservoir. With the apparatus of this invention the same barrel and nib holder configuration can be utilized to form conventional single ended markers with stamping nibs or marking nibs as well as double ended markers with any combination of stamping and/or marking nibs for use therewith. In this manner, numerous different configurations of marker apparatus can be manufactured utilizing the same basic configuration for the barrel nib holder, nib and cap used therewith.

7 Claims, 4 Drawing Sheets

U.S. PATENT DOCUMENTS 3,776,646 12/1973 Bich .
3,865,496 2/1975 Robbins .
3,918,819 11/1975 Liu .
3,941,488 3/1976 Maxwell .
4,082,467 4/1978 Kaplan .
4,104,781 8/1978 Midorikawa .
4,156,657 5/1979 Lin .
4,212,393 7/1980 Lenkoff .
4,213,717 7/1980 Lin .
4,221,490 9/1980 Malm .
4,227,822 10/1980 Kokubu .
4,229,115 10/1980 Olinsky .
4,406,555 9/1983 Tsai .
4,452,142 6/1984 Eckels .
4,509,875 4/1985 Shintani .
4,549,827 10/1985 Mack .
4,557,618 12/1985 Iwata et al. .
5,017,034 5/1991 Stary et al. .
5,222,823 6/1993 Conforti .
5,286,127 2/1994 Scholz .
5,338,123 8/1994 Obersteller et al. .
5,388,924 2/1995 Chao .
5,499,881 3/1996 Chang .
5,553,901 9/1996 Serot .

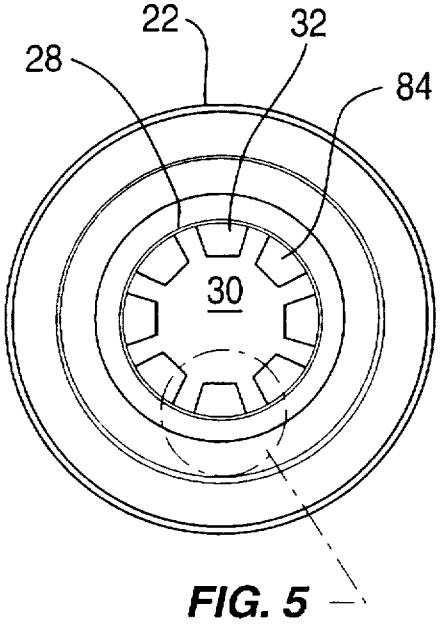
FIG. 5
FIG. 7
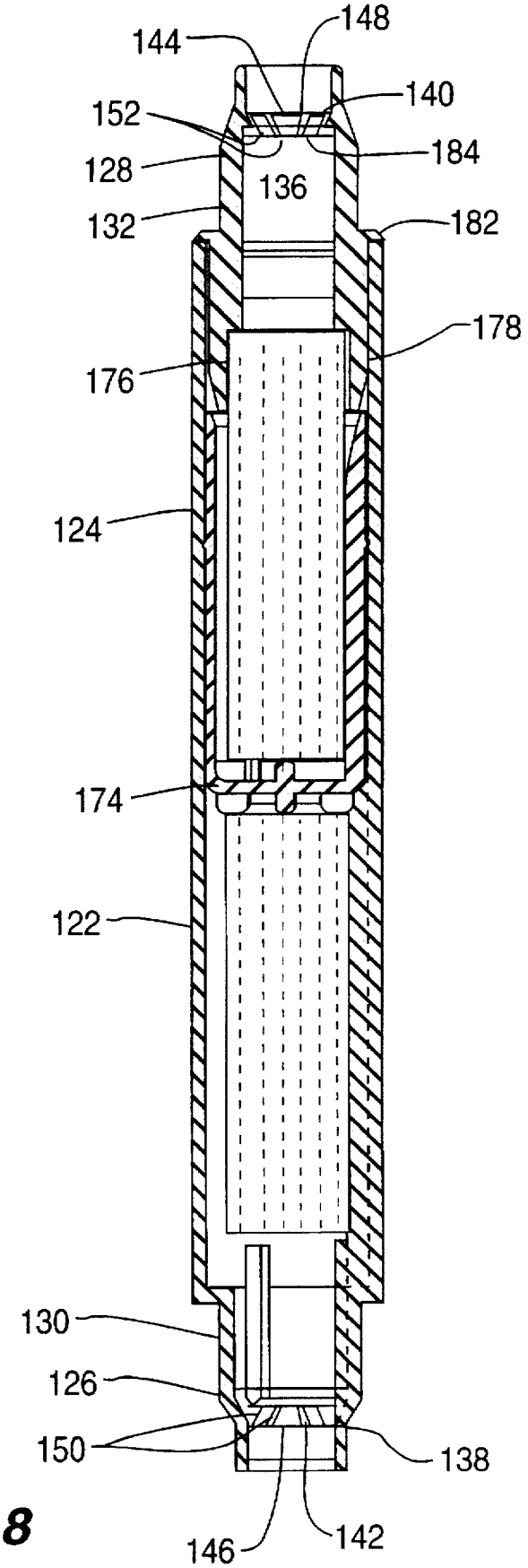
FIG. 8

UNIVERSAL MARKING INSTRUMENT APPARATUS

This application is a division of U.S. application Ser. No. 08/923,305 filed Sep. 4, 1997 on Universal Marking Instrument Apparatus by Richard Ginelli and assigned to Pentech International Inc. and priority thereon is now claimed.

BACKGROUND OF THE INVENTION

1. Field Of The Invention

The present invention deals with the field of marker devices utilized for providing various marks upon substrates. Such marking instruments are normally provided with a single reservoir for marking fluid positioned within a barrel with a nib in fluid flow communication with the reservoir to allow marking by the opposite end of the nib as desired. Some such marking instruments may include nibs having angular or slanted surfaces or pointed surfaces to facilitate writing therewith and others may include horizontal or block nib ends for stamping one or more designs as desired therewith. Other marking instrument configurations may include double ended markers wherein both ends of the barrel are utilized for marking and wherein the configuration of each nib is different to achieve different marking effects as desired. Alternatively stamping can be provided for one or more ends. The use of double ended and single ended marking and stamping writing instruments is well known. However, the present invention provides a unique configuration for the nib retaining member which allows formation of different configurations of nibs and markers utilizing the same barrel, nib holder and nib parts.

The present invention further includes a uniquely configurated separating plug member which includes plug ridges and plug ribs for defining clearance spacing between the walls of the plug and the fibrous reservoir member in order to minimize wicking and increase the evenness of flow of the media to the marking tips.

2. Description Of The Prior Art

Various prior art designs for markers both single and double ended have been patented such as U.S. Pat. No. 1,108,314 patented Aug. 25, 1914 to M. M. Anderson on a "Pencil Stamp"; and U.S. Pat. No. 2,456,904 patented Dec. 21, 1948 to N. H. Wahlstrom on a "Stamp"; and U.S. Pat. No. 2,783,711 patented Mar. 5, 1957 to H. Vance on a "Stamp"; and U.S. Pat. No. 3,043,316 patented Jul. 10, 1962 to M. E. Bolser on an "Applicator For Fluids"; and U.S. Pat. No. 3,251,344 patented May 17, 1966 to E. N. Dorna et al on a "Writing Utensil"; and U.S. Pat. No. 3,684,389 patented Aug. 15, 1972 to A. Eron et al on a "Double-Ended Marking Pen"; and U.S. Pat. No. 3,690,777 patented Sep. 12, 1972 to A. Cost on a "Double Dispensing Applicator With Twin Reservoirs"; and U.S. Pat. No. 3,733,139 patented May 15, 1973 to J. Neidhardt et al on a "Dual Writing Instrument"; and U.S. Pat. No. 3,765,780 patented Oct. 16, 1973 to B. Guu et al on "Writing Implements"; and U.S. Pat. No. 3,865,496 patented Feb. 11, 1975 to G. Robbins on a "Combination Pen And Pencil Writing Device"; and U.S. Pat. No. 3,918,819 patented Nov. 11, 1975 to H. Liu and assigned to Kent Industrial Corporation on a "Writing Implement"; and U.S. Pat. No. 3,941,488 patented Mar. 2, 1976 to D. Maxwell on a "Marker/Anti-Marker System"; and U.S. Pat. No. 4,104,781 patented Aug. 8, 1978 to Y. Midorikawa and assigned to Glasrock Products, Inc. on a "Method of Manufacturing A Marking Pen Having A Nib And An Ink Reservoir Integral Therewith"; and U.S. Pat. No. 4,156,657 patented May 29, 1979 to A. Lin and assigned to Burroughs Corporation on a "Ball Point Pen, Ink And Its Eradicator System"; and U.S. Pat. No. 4,212,393 patented Jul. 15, 1980 to L. Lenkoff on "Magic Pictures"; and U.S. Pat. No. 4,213,717 patented Jul. 22, 1980 to A. Lin and assigned to Burroughs Corporation on a "Ball Point Pen, Ink And Its Eradicator System"; and U.S. Pat. No. 4,221,490 patented Sep. 9, 1980 to C. Malm and assigned to The Gillette Company on a "Two Ended Retractable Writing Instrument"; and U.S. Pat. No. 4,227,822 patented Oct. 14, 1980 to T. Kokubu and assigned to Zebra Co., Ltd. on a "Composite Writing Instrument"; and U.S. Pat. No. 4,229,115 patented Oct. 21, 1980 to L. Olinsky and assigned to Binney & Smith, Inc. on a "Nib For A Writing Instrument"; and U.S. Pat. No. 4,406,555 patented to K. Tsai and assigned to Cathay Pen Corporation on Sep. 27, 1983 on a "Nib Replaceable Writing Instrument"; and U.S. Pat. No. 4,452,142 patented Jun. 5, 1984 to R. Eckels on a "Multiple Head Rubber Stamp"; and U.S. Pat. No. 4,509,875 patented Apr. 9, 1985 to K. Shintani and assigned to Colleen Pencil Co., Ltd. on a "Felt Pen Having Two End Caps"; and U.S. Design Pat. No. Des.279,992 patented Aug. 6, 1985 to S. Gribb on a "Dual Tip Marking Instrument"; and U.S. Pat. No. 4,549,827 patented Oct. 29, 1985 to W. Mack on a "Writing Implement With Two Retractable Cartridges"; and U.S. Pat. No. 4,557,618 patented Dec. 10, 1985 to M. Iwata et al and assigned to Pentel Kabushiki Kaisha on an "Ink And Eraser Of The Ink"; and U.S. Design Pat. No. Des.295,878 patented May 24, 1988 to J. Lovell on a "Dual Applicator Marking Instrument"; and U.S. Pat. No. 5,017,034 patented May 21, 1991 to J. Stary et al on a "Marker And Pen Combination Employing Transverse And Longitudinally Spaced Tips"; and U.S. Design Pat. No. Des.321,717 patented Nov. 19, 1991 to L. Hager on a "Combined Ball-Point Pen And Correction Fluid Applicator"; and U.S. Pat. No. Des.328,917 patented Aug. 25, 1992 to T. Shike et al and assigned to Tokai Corporation on a "Twin-Nibbed Ball-Point Pen"; and U.S. Design Pat. No. Des.329,873 patented Sep. 29, 1992 to C. Tu and assigned to Chuang Tao Corporation on a "Marking Instrument"; and U.S. Design Pat. No. Des.336,425 patented Jun. 15, 1993 to J. Napora, Jr. on a "Double Ended Marking Instrument"; and U.S. Design Pat. No. Des.336,922 patented to C. Lin on Jun. 29, 1993 for a "Ball-Point Pen"; and U.S. Pat. No. 5,222,823 patented Jun. 29, 1993 to P. Conforti on a "Device For Marking Tickets For Game Of Chance With Translucent, Vibrant Colored Ink"; and U.S. Pat. No. 5,338,123 patented Aug. 16, 1994 to U. Obersteller et al and assigned to Pelikan GmbH on a "Double-Ended Pen"; and U.S. Pat. No. 5,388,924 patented Feb. 14, 1995 to C. Chao on a "Drawing Pen Having Multiple Side-Matched Absorptive Drawing Tips"; and U.S. Design Pat. No. Des.355,933 patented to S. Collins on Feb. 28, 1995 on a "Combination Writing Instrument And Bookmark"; and U.S. Design Pat. No. Des.362,649 patented Sep. 26, 1995 to R. Rak et al and assigned to Motorola, Inc. on a "Stylus Pen"; and U.S. Design Pat. No. Des.366,279 patented to S. Voorhees and assigned to Inventure Development Corporation on Jan. 16, 1996 on a "Marker"; and U.S. Pat. No. 5,499,881 patented Mar. 19, 1996 to P. Chang on a "Writing Implement With Correction Supply".

SUMMARY OF THE INVENTION

The present invention provides a universal marking instrument apparatus which has been found to be particularly usable in the manufacturing of marking instruments having many various configurations wherein similar parts are utilized for each.

In this design a barrel is included which is generally tubular and defines a reservoir therewithin. This barrel further defines an opening therein in fluid flow communication with respect to the reservoir and can define an opening in each opposite tubular end. Marking media is positioned within the reservoir for supply thereof through the opening to facilitate marking with the marker apparatus. In preferred configurations a fibrous reservoir element is included within the reservoir for facilitating retaining of marking media therein.

A nib holder is included in the present invention preferably mounted within the barrel in the opening thereof. The nib holder preferably includes a nib holder housing defining a media transfer channel extending therethrough. The media transfer channel is preferably positioned in fluid flow communication with respect to the reservoir for facilitating the transfer of marking media therethrough. A nib mounting ring is also attached to the nib holder housing within the media transfer channel and defines a ring mounting aperture therewithin. A securement prong member or members are also attached to the nib mounting ring and extend obliquely axially inward therefrom to facilitate retaining of a nib therewithin.

A nib is also included positioned extending within the media transfer channel in the nib holder means in fluid flow communication with respect to the reservoir to receive marking media therefrom to facilitate marking.

Each nib preferably includes a nib mounting segment extending through the ring mounting aperture of the nib mounting ring to facilitate alignment of the nib axially within the media transfer channel and also to aid in retaining the nib therewithin. These securement prongs are preferably engageable with the nib mounting segment positioned extending through the ring mounting aperture to further facilitate retaining of the nib therein. A nib marking segment is also preferably included adapted to receive marking media from the reservoir means and to be used for abutment with substrates for writing.

A cap may also be detachably securable to the nib holder in surrounding relationship with respect to the nib positioned therewithin to facilitate protection. The cap may be selectively removable from engagement with respect to the nib holder in order to facilitate marking by the nib marking segment of the nib.

In the preferred configuration the nib holder also will include radial support member attached to the nib holder housing and to the nib mounting ring within the media transfer conduit to facilitate positioning of the ring mounting aperture defined therein.

Preferably the securement prongs as well as the nib mounting ring are of a flexibly resilient material to facilitate flexing thereof during placement of the nib into the ring mounting aperture. This flexible characteristic will also allow the securement prongs to dig into or firmly abut against the outer surface of the nib mounting segment of the nib after insertion thereof to facilitate retaining of the nib therewithin and prevent accidental or inadvertent detachment thereof after insertion. Preferably these securement prongs or finger members will be axially oriented inwardly and also rearwardly toward the reservoir to facilitate gripping and biasing of the nib within the ring mounting aperture.

The nibs of the present invention and, in particular, the nib marking segments thereof can be of any chosen configuration. For example, a point or angular marking surface is often included on the nib marking segment to facilitate writing therewith. Alternatively, a horizontal stamping surface can be included which may include a design to facilitate stamping-type marking therewith.

In a preferred configuration of the present invention the nib holder will be integrally formed with respect to the barrel on one end thereof. In all configurations of writing instruments at least one nib holder is necessary and therefore the integral forming of these parts is preferable. If a double ended marker design is desired, then a separately configured nib holder device can be included having a holder mounting means on the exterior thereof. This holder mounting means preferably includes a peripheral engagement surface adapted to abut the open end of the barrel adjacent the opening thereof. Furthermore the holder mounting construction preferably also includes a peripheral ribbing located on the external surface of this peripheral engagement surface in order to further facilitate engagement with respect to a barrel. A shoulder member may also be included extending outwardly from the peripheral engagement surface which is adapted to abut the barrel adjacent the opening defined therein to facilitate securement therebetween. The shoulder is preferably operable to limit the depth of positioning of the nib holder within the opening as desired.

The nib holder of the present invention preferably includes a plurality of radial support members which can also be of flexibly resilient material which are attached to the nib holder housing and extend therefrom into the media transfer channel means and are attached to the nib mounting means in order to maintain proper orientation thereof. In certain configurations of the present invention utilizing double ended markers it may also be necessary to use two separate reservoirs each including a different marking media. With such a configuration a separating plug may be positioned within the barrel to divide the reservoir into two separate chambers which can hold the readily distinguishable marking media as desired. With any of the configurations of double marking members the configurations of the marking nibs can be chosen from a variety of different possible configurations.

In the preferred configuration of the separating plug member it will preferably include a plurality of plug ridges on the inner and outer flat portions of the ends thereof. Preferably the inside diameter clear portions will include plug ribs extending therealong. These ridges and ribs are positioned therein to define clearance spaces between the walls of the separating plug and the preferably fibrous reservoir in abutment therewith. It has been found that such clearance spaces will increase the evenness of flow of marking media to the marking tips because these clearance spaces will eliminate media leakage and undesirable wicking. Overall these clearance spaces have been proven to increase the evenness of flow of marking media from the preferably fibrous reservoir to the one or more marking tips of the particular marking instrument.

It is an object of the present invention to provide a universal marking instrument apparatus usable for forming marking instruments of various configurations wherein a single barrel can be utilized for single and double ended markers.

It is an object of the present invention to provide a universal marking instrument apparatus usable for forming marking instruments of various configurations wherein a single nib holder configuration can be utilized for single and double markers.

It is an object of the present invention to provide a universal marking instrument apparatus usable for forming marking instruments of various configurations wherein a single nib holder is integrally formed with a barrel and a separate similarly configured nib holder can be positioned in the opposite end for forming of double ended markers as desired.

It is an object of the present invention to provide a universal marking instrument apparatus usable for forming marking instruments of various configurations wherein double ended markers can be formed with separated reservoirs or a single common reservoir utilizing the same marking instrument parts.

It is an object of the present invention to provide a universal marking instrument apparatus usable for forming marking instruments of various configurations wherein cost of maintaining inventory for the manufacture of marking instruments is minimized.

It is an object of the present invention to provide a universal marking instrument apparatus usable for forming marking instruments of various configurations wherein production and manufacturing delays in the manufacturing of marking instruments is minimized.

It is an object of the present invention to provide a universal marking instrument apparatus usable for forming marking instruments of various configurations wherein the number of injection molding dyes utilized for the manufacturing of writing instruments is minimized.

It is an object of the present invention to provide a universal marking instrument apparatus usable for forming marking instruments of various configurations wherein both stamping and writing marking instrument nibs can be utilized as desired selectively in the manufacture of writing instruments.

It is an object of the present invention to provide a universal marking instrument apparatus usable for forming marking instruments of various configurations wherein various configurations of nibs can be selectively retained within a marking instrument without requiring gluing or cementing of the nib in position.

It is an object of the present invention to provide a universal marking instrument apparatus usable for forming marking instruments of various configurations wherein various configurations of nibs can be selectively retained within a marking instrument without requiring pinning of the nib in position.

It is an object of the present invention to provide a universal marking instrument apparatus usable for forming marking instruments of various configurations wherein the marker barrel nib holder and cap can all be formed of the same flexibly resilient material such as polypropylene.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 7 is a side plan view of an embodiment of the nib holder of FIG. 3 as seen from the right;

FIG. 8 is a side cross-sectional view of an embodiment of a double ended marker of the present invention;

DETAILED DESCRIPTION OF THE PREFERRED EMBODIMENT

Figure 1:
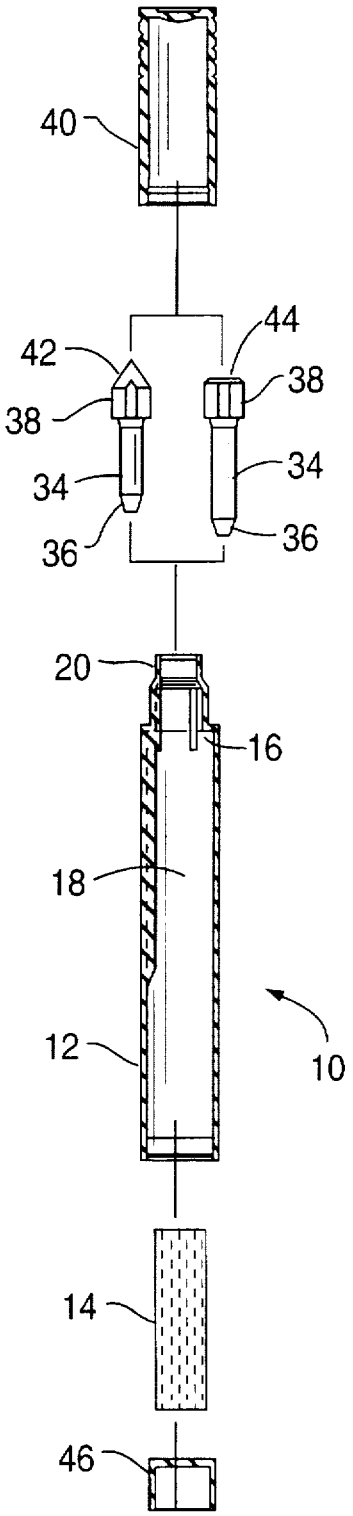
FIG. 1 is a side cross-sectional view of the preferred embodiment of the marking instrument made in accordance with the present invention.

The present invention provides a marking instrument 10 which preferably includes a conventional barrel means 12 of tubular configuration. Barrel 12 is designed to include a reservoir 14 therewithin for holding of marking media 18 as desired. The reservoir 14 can include a fibrous reservoir member therein to facilitate the holding of marking media 18 in the interstices between the fibrous members. Barrel 12 preferably includes an opening means 16 at one end thereof to allow the marking media 18 to transfer therethrough for marking.

A nib holder 20 is preferably included which includes a nib holder housing 22 defining a media transfer channel 24 preferably extending axially therethrough.

A nib 34 is included to facilitate marking and includes a nib mounting segment 36 to facilitate mounting of the nib 34 to the nib holder 20 as well as a nib marking segment 38 to facilitate marking therewith. Nib marking segment 38 can include an angular marking surface 42 thereof to facilitate conventional writing. Alternatively or in addition, the nib marking segment 38 of the nib 34 can include a more horizontally oriented stamping surface 44. These stamping surfaces can be blank or can include alphanumeric characters or designs thereon as desired in the manufacture of the specific marker design.

The nib holder 22 preferably includes a nib mounting ring 28 therewithin which is adapted to receive the nib mounting segment 36 extending thereinto for mounting. Nib mounting ring 28 maintains the axial orientation of the nib 34 as well as the mounting segment 36 and marking segment 38 thereof centrally axially with respect to the barrel 12. This is made possible by the nib mounting ring 28 defining a ring mounting aperture 30 therewithin which is adapted to receive the nib mounting segment 36 specifically positioned therewithin. Radial support members 26 can be included for maintaining the axial orientation of the nib mounting ring 28 with respect to the barrel 12.

In order to facilitate placement of the nib 34 within the mounting aperture 30 and to maintain securement thereof once placed, a plurality of securement prongs 32 or, as shown in FIG. 7, resiliently flexible finger members 84 can be included which extend axially inwardly in a converging manner and rearwardly toward the reservoir. These securement prongs 32 by being inclined toward the reservoir will allow movement of the nib 34 into position with the nib mounting segment 36 within the ring mounting aperture 30. At the same time the securement prongs 32 will hold or retain the nib mounting segment 36 in position within the nib mounting ring 28 after it has been so placed. In the preferred configuration the securement prongs 32 also urge the nib mounting segment 36 into abutment with respect to the reservoir 14 to facilitate the flow of marking media 18 from the reservoir 14 through the nib mounting segment 36 to the nib marking segment 38 to facilitate marking and/or stamping as desired.

A cap 40 may also be included detachably securable with respect to the nib holder 20 for protection as desired of the nib member 34 held within the nib holder 20 therein. In the preferred configuration of the present invention the nib holder 20 will be integrally formed with respect to the barrel 12 as shown in FIG. 1. With this configuration a marker with at least one operative end is achieved. It is possible that a single ended marker could be utilized with a removable or separate piece configuration for the nib holder 20 but, as shown in FIG. 1, nib holder 20 is integral with barrel 12.

Figure 2:
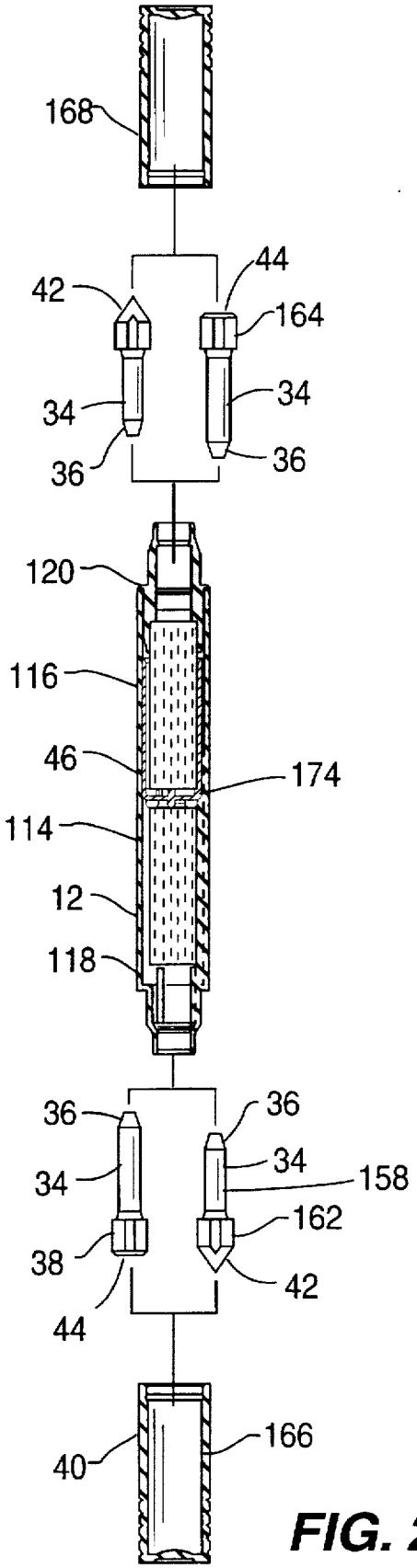
FIG. 2 is a side cross-sectional view of a double ended marker made in accordance with the apparatus of the present invention.
Figure 3:
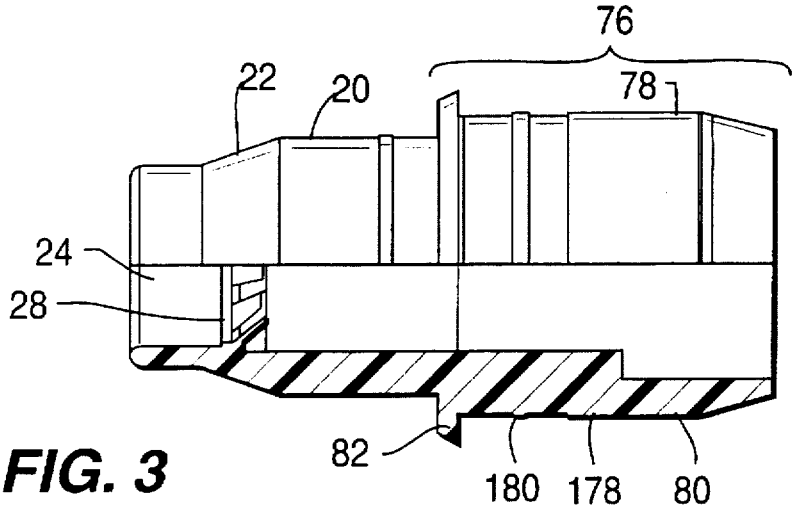
FIG. 3 is a side cross-sectional view of an embodiment of a nib holder means of the present invention.

An important aspect of the present invention is the universal nature of the apparatus used to manufacture the marking instruments disclosed. The base configuration preferably includes the tubular barrel 12 with one nib holder 20 integrally formed with one end thereof or one separate piece nib holder as shown in FIG. 3 positioned in one end of barrel 12. In all configurations of markers at least one marking end is required and, as such, the use of the integral form for the nib holder 20 is preferred. However, it is not a required element that the two parts be integral. In the double ended configuration as shown in FIG. 2 the separately configured nib holder 20 can be positioned in the opposite opening from the integrally formed nib holder to form a double ended marker if desired. As such, single and double ended markers in this manner can both be formed from the same apparatus thereby minimizing the amount of inventory required and the number of molds which need to be made to achieve manufacture with the more commonly used plastic materials such as polypropylene.

In the configuration where the nib holder 20 is a separate piece, a nib holder mounting means 76 is included to facilitate securement between the nib holder 20 and the opening defined in the barrel. The nib holder mounting means 76 preferably includes a peripheral engagement surface 78 extending preferably circumferentially therearound designed to engage the interior portion of the tubular area of the barrel 12. Alternatively, a peripheral ribbing means 80 can be included extending therearound. One or more specific ribs can be utilized and the spacing of the ribs can be varied from a very narrow rib to more broad based engaging ribs. In either case the peripheral ribs 80 facilitate engagement between the peripheral engagement surface 70 and the tubular barrel 12. A shoulder means 82 can be included to limit the depth of penetration of the peripheral engagement surface 78 with respect to the barrel 12. Preferably the shoulder member 82 will be brought into abutment with the end of barrel 12 immediately adjacent to the opening in which the nib holder 20 is being placed.

An important aspect of the present invention is in the flexibly resilient material from which the securement prongs 32 and the nib mounting ring 28 are formed. These soft pliable and yet flexible materials need be flexible in order to allow movement of the nib 34 into position within the ring mounting aperture 30. The nib mounting ring 28 is preferably resiliently flexible to allow central axial positioning of the nib mounting segment 36 within the barrel 12. At the same time the securement prongs 32 need be flexible such that they can be urged to the side during movement of the nib 34 and, in particular, the nib mounting segment 36 inwardly to the point where preferably it is in abutting contact with respect to the fibrous reservoir member 14. Once the nib 34 is in position to receive marking media 18 from the reservoir 14, the securement prongs 32 will dig into the sides or strongly abut the sides of the relatively soft nib 34 in such a manner as to prevent its exit from the position within the ring mounting aperture 30. In this manner accidental removal of the nib 34 will be prevented.

In a preferred configuration as seen best in FIG. 2, a double ended marker 112 can be manufactured in accordance with the apparatus of the present invention. With this configuration the barrel 12 of the double ended marker 112 will include a first opening means 118 as well as a second opening means 120 preferably oppositely configured therein in opposite ends of the tubular barrel. A first nib holder 126 will be positioned within the first opening 118. First nib holder 126 can be integrally formed with respect to the barrel 12 at the first opening or can be a separate member as above described. A second nib holder 128 preferably comprising a separate discreet member is also preferably included of a configuration similar to that of the first nib holder 126 in regard to the nib holding aspects thereof and is adapted to be positioned within the second opening 120.

The first nib holder 126 will include a conventional configuration as described in the nib holder 20 hereabove and, as such, will include a first nib holder housing 130 defining a first media transfer channel 134 therewithin. A first radial support member 138 can be included for maintaining orientation of the first nib mounting ring 142 and the first ring mounting aperture 146 defined therein. A plurality of first securement prongs 150 can extend rearwardly within the first media transfer channel 134 and angled toward the reservoir 14 defined therein to facilitate attachment of a first nib means 154 therein while at the same time allowing movement of the nib means to this secured position. The first nib 154 so positioned will include a first nib mounting segment 158 which is adapted to extend through the first ring mounting aperture 146 to be secured by the first securement prong 150. The first nib 154 will include a first nib marking segment 162 for marking thereby. A first cap 166 will be selectively securable with respect to the first nib holder 126 for protection of the first nib 154 therewithin.

The second nib holder 128 will also be of a similar configuration to the first nib holder 126. However, since it is preferably a discreet element, it will include a holder mounting means 176. Second nib holder 128 will preferably comprise a second nib holder housing 132 defining a second media transfer channel 136 therewithin. A second radial support member 140 will be secured to the second nib mounting ring 144 and the second nib holder housing 132 to maintain orientation of the second ring mounting aperture 148 defined therein axially within the barrel 12. A second securement prong means 152 will extend rearwardly from the second ring aperture 148 and will be preferably formed of flexibly resilient material for allowing placement of a second nib 156 into position within the second ring aperture 148 while at the same time maintaining securement therein once so placed. The second nib 156 will also include a second nib mounting segment 160 which is the portion of the second nib 156 which is actually positioned extending into the second nib mounting ring 144. Preferably integral with the second nib mounting segment 160 is the second nib marking segment 164. Second nib marking segment 164 and first nib marking segment 162 can either or both be formed with angular marking surfaces 42 or horizontal stamping surface 44 as desired to provide various alternative constructions for the final marker to achieve desired effects of writing or stamping as desired. A second cap 168 may also be included secured to the second nib holder 128 in order to protect the second nib 156 positioned therewithin.

With the above configuration for the double ended marker 112 both marking nib segments 162 and 164 will receive the same marking media 18 from the same reservoir 14. However, if it is desired to have separate and perhaps different marking media, namely, first marking media 122 and second marking media 124, then the reservoir can be divided for this purpose. To achieve this construction a separating plug member 174 can be positioned within the interior of the tubular barrel 12 to divide the reservoir 14 into a first reservoir area 114 and a second reservoir area 116. Preferably the first reservoir area 114 includes a first fibrous reservoir member having a first marking media 122 impregnated therethroughout. Similarly the second reservoir means 116 preferably includes a second fibrous reservoir member which itself is impregnated with a second marking media 124. With this configuration the apparatus of the present invention provides the capability for forming a marking instrument utilizing the same barrel nib and cap configurations for single ended markers, double ended markers and double ended markers designed to supply different colors or other marking media to the two opposite marking ends.

Figure 11:
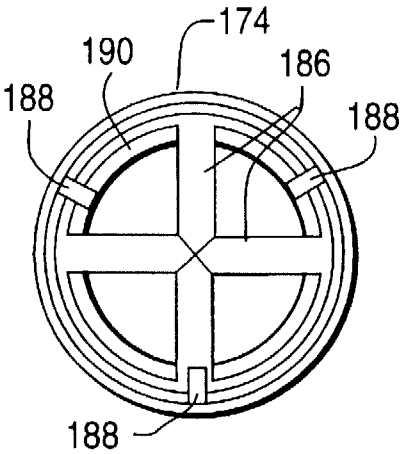
FIG. 11 is an end plan view of the configuration showing FIG. 9 taken as seen from the right.
Figure 9:
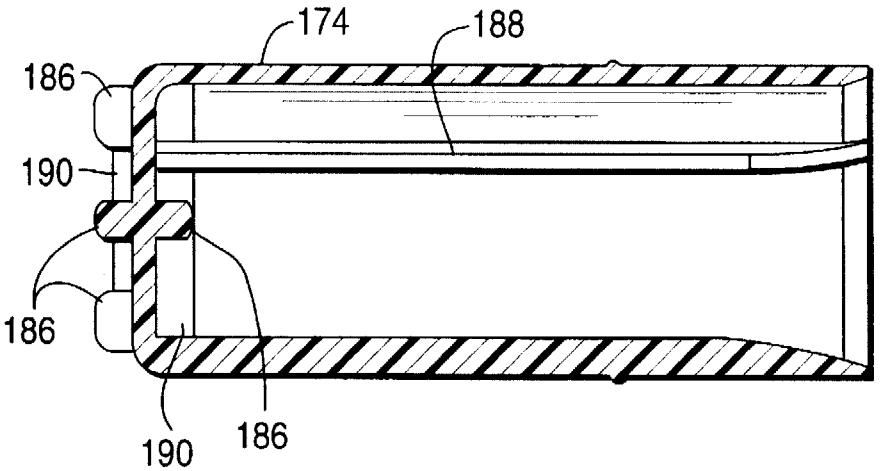
FIG. 9 is a side cross-sectional view of an embodiment of the separating plug member of the present invention showing the ridges, ribs and clearance spaces defined therein.
Figure 10:
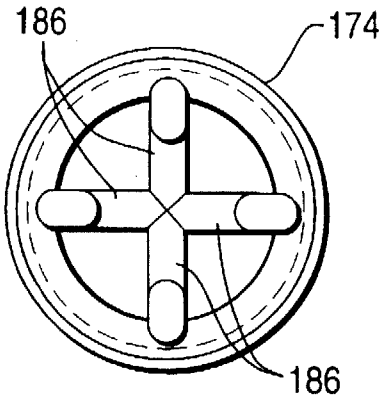
FIG. 10 is an end plan view of the configuration showing FIG. 9 taken from the left.

A particular construction for the interior and exterior flat walls of the separating plug member 174 has been found to be particular advantageous when used with the apparatus of the present invention. Preferably separating plug member 174 includes plug ridges 186 along the ends thereof both on the interior portion and the exterior portion thereof. Additionally it is preferable that the separating plug member 174 include plug ribs 188 along the inside diameter of the length thereof. The ridges 186 and the ribs 188 are included in order to provide a clearance spacing 190 between the body of the separating plug member 174 and the reservoir 14 which is preferably fibrous. This clearance space can be relatively small but is important in order to enhance the evenness of flow of the marking media 18 from the reservoir 14 to the marking nibs. These clearance spaces 190 both on the ends and along the interior barrel of the separating plug member 174 have been shown to prevent wicking and other undesirable problems associated with unwanted leakage of marking media 18 from the fibrous reservoir 14. One of the primary advantages of the clearance spacing 190 is in the minimizing of wicking problems which often occur due to capillary forces encountered by the marking media when the fibrous reservoir 14 is in direct abutment with the body of the separating plug member 174. The definition of the clearance spacing 190 by the plug ridges 186 and the plug ribs 188 greatly minimize these problems and are clearly shown in FIGS. 9, 10 and 11.

With the configuration of the double ended marker 112 described above a holder mounting means 176 is preferably included in the second nib holder 128. Since the first nib holder 126 is preferably integrally formed with the barrel 12, the second nib holder 128 should be a separate discreet element. If a single ended marker is utilized then this second opening is merely sealed or closed with a plug member 174 as necessary. Alternatively, that opposite end of the tubular barrel 12 could be merely integrally formed as being closed.

Figure 4:
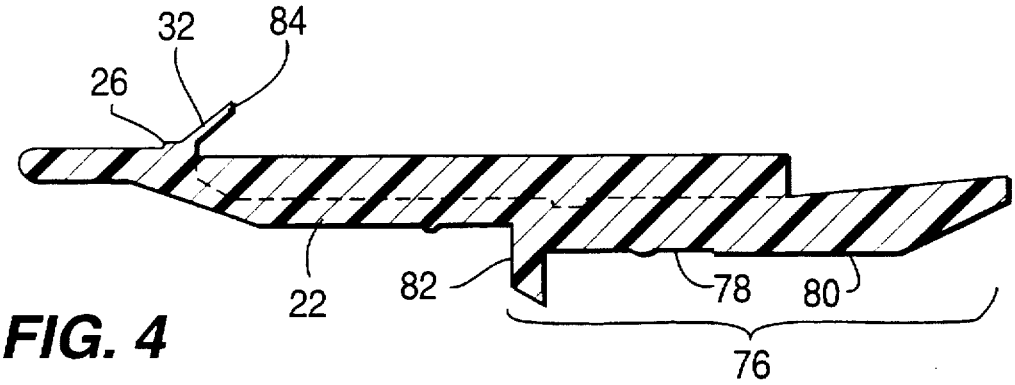
FIG. 4 is a side cross-sectional view of a preferred configuration for the wall configuration of the nib holder shown in FIG. 3.
Figure 5:
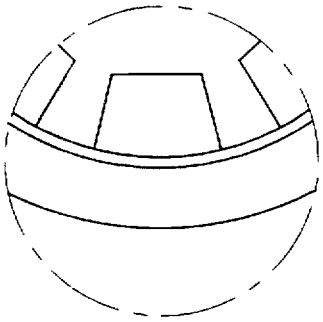
FIG. 5 is an end plan view of an embodiment of the prong means of the present invention.
Figure 6:
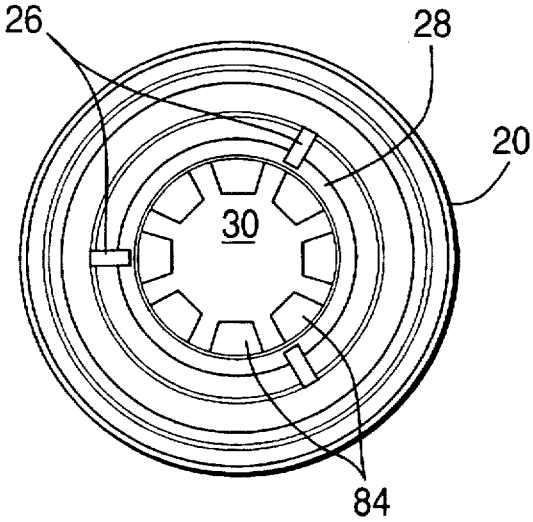
FIG. 6 is a side plan view of an embodiment of the nib holder of FIG. 3 as seen from the left.

The separate and discreet second nib holder 128 mounting within the second opening 120 of the double ended marker 112 is an important characteristic. For this purpose the holder mounting means 176 is included. Preferably this mounting enhancement means includes a peripheral engagement surface 178 extending about the outer peripheral surface of the second nib holder 128. This peripheral engagement surface 178 is adapted to engage the interior of the tubular barrel 12 adjacent the second opening means 120. To further insure engagement of this surface 178 a peripheral ribbing means 180 may be included thereon. This engaging means as shown in FIG. 4 can be a single circumferential ribbing or can be a broader engaging ribbing to maintain sealed and firm contact between the peripheral engagement surface 178 and the interior wall of the tubular barrel. A shoulder member 182 can also be included for limiting the depth of penetration of the second nib holder 128 into the second opening 120.

One of the most important aspects of the present invention is the resiliently flexible finger members 184 which provide the first securement prong means 150 and the second securement prong means 152. With this configuration the nibs can be placed through the appropriate apertures in the single or double marker configuration and once they are in place removal thereof is prevented by the angular orientation of these flexible fingers with respect to the mounting portion of the nib.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A universal marking instrument apparatus usable for forming marking instruments of various configurations comprising:

A. a barrel means being generally tubular and defining a reservoir means therewithin, said barrel means further defining an first opening means therein in fluid flow communication with respect to said reservoir means and a second opening means therein in fluid flow communication with respect to said reservoir means, said reservoir means including a first fibrous reservoir member and a second fibrous reservoir member positioned extending within said barrel means;

B. marking media positioned within said reservoir means for supply thereof through said first opening means and said second opening means to facilitate marking;

C. a first nib holder means mounted in said barrel means within said first opening means thereof and further comprising:

(1) a first nib holder housing means defining a first media transfer channel means extending therethrough, said first media transfer channel means being in fluid flow communication with respect to said reservoir means for facilitating passing of said marking media therethrough;

(2) a first nib mounting ring means attached to said first nib holder housing means within said first media transfer channel means and defining a first ring mounting aperture means therewithin;

(3) a first securement prong means including a plurality of resiliently flexible finger members attached to said first nib mounting ring means and extending obliquely axially inwardly therefrom to urge a first nib means retained within said first nib mounting ring means into abutting engagement with respect to said first fibrous reservoir member to enhance transfer of said marking media thereto to further facilitate marking therewith;

D. said first nib means positioned extending within said first media transfer channel means of said first nib holder means in fluid flow communication with respect to said reservoir means to receive said marking media therefrom to facilitate marking therewith, said first nib means including:

(1) a first nib mounting segment extending through said first ring mounting aperture means of said first nib mounting ring means to facilitate alignment of said first nib means axially within said first media transfer channel means and to retain said first nib means therewithin, said first securement prong means of said first nib holder means being engageable with said first nib mounting segment positioned extending through said first ring mounting aperture means to further facilitate retaining of said first nib means therein;

(2) a first nib marking segment adapted to receive said marking media from said reservoir means for facilitating marking therewith;

E. a first cap means detachably securable to said first nib holder means in surrounding relation with respect to said first nib means positioned therewithin for protection thereof, said first cap means being selectively removable from said first nib holder means to facilitate marking by said first nib marking segment of said first nib means;

F. a second nib holder means mounted in said barrel means within said second opening means thereof and further comprising:

(1) a second nib holder housing means defining a second media transfer channel means extending therethrough, said second media transfer channel means being in fluid flow communication with respect to said reservoir means for facilitating passing of said marking media therethrough;

(2) a second nib mounting ring means attached to said second nib holder housing means within said second media transfer channel means and defining a second ring mounting aperture means therewithin;

(3) a second securement prong means including a plurality of resiliently flexible finger members attached to said second nib mounting ring means and extending obliquely axially inwardly therefrom to urge a second nib means retained within said second nib mounting ring means into abutting engagement with respect to said second fibrous reservoir member to enhance transfer of said marking media thereto to further facilitate marking therewith;

G. said second nib means positioned extending within said second media transfer channel means of said second nib holder means in fluid flow communication with respect to said reservoir means to receive said marking media therefrom to facilitate marking therewith, said second nib means including:

(1) a second nib mounting segment extending through said second ring mounting aperture means of said second nib mounting ring means to facilitate alignment of said second nib means axially within said second media transfer channel means and to retain said second nib means therewithin, said second securement prong means of said second nib holder means being engageable with said second nib mounting segment positioned extending through said second ring mounting aperture means to further facilitate retaining of said second nib means therein;

(2) a second nib marking segment adapted to receive said marking media from said reservoir means for facilitating marking therewith; and H. a second cap means detachably securable to said second nib holder means in surrounding relation with respect to said second nib means positioned therewithin for protection thereof, said second cap means being selectively removable from said second nib holder means to facilitate marking by said second nib marking segment of said second nib means.

2. A universal marking instrument apparatus usable for forming marking instruments of various configurations as defined in claim 1 wherein said first nib marking segment includes an angular marking surface to facilitate marking therewith.

3. A universal marking instrument apparatus usable for forming marking instruments of various configurations as defined in claim 1 wherein said second nib marking segment includes a horizontal stamping surface to facilitating stamping therewith.

4. A universal marking instrument apparatus usable for forming marking instruments of various configurations as defined in claim 1 wherein said first nib holder means is integrally formed with said barrel means in position within said opening means defined therein.

5. A universal marking instrument apparatus usable for forming marking instruments of various configurations as defined in claim 1 wherein said reservoir means includes a first reservoir member and a second reservoir member and wherein said marking media comprises a first marking medium and a second marking medium, said first marking medium being positioned within said first reservoir member for transfer to said first nib means and said second marking medium being positioned within said second reservoir member for transfer to said second nib means.

6. A universal marking instrument apparatus usable for forming marking instruments of various configurations as defined in claim 5 further comprising a separating plug member positioned within said barrel means to divide said reservoir means into said first reservoir member and said second reservoir member to maintain said first marking medium and said second marking medium separated from one another.

7. A universal marking instrument apparatus usable for forming marking instruments of various configurations as defined in claim 5 wherein said separating plug member includes ridges and ribs therein to facilitate maintaining of said reservoir means spatially disposed from said separating plug member to facilitate flow of marking media to said first nib means and said second nib means by defining a clearance spacing between said reservoir means and said separating plug to prevent undesirable wicking and for flow enhancement.

* * * * *